US010443614B2

(12) United States Patent
Racca et al.

(10) Patent No.: US 10,443,614 B2
(45) Date of Patent: Oct. 15, 2019

(54) COMPRESSOR HOUSING

(71) Applicant: GM GLOBAL TECHNOLOGY OPERATIONS LLC, Detroit, MI (US)

(72) Inventors: Alberto Racca, Cavallermaggiore (IT); Cesare Maria Meano, Turin (IT); Jesus Vicente Benajes Calvo, Valencia (ES); Jose Maria Desantes Fernandez, Valencia (ES); Jose Galindo Lucas, Valencia (ES); Roberto Navarro Garcia, Valencia (ES); Pedro Piqueras Cabrera, Valencia (ES); Joaquin De La Morena Borja, Valencia (ES)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 283 days.

(21) Appl. No.: 15/413,082

(22) Filed: Jan. 23, 2017

(65) Prior Publication Data

US 2017/0211587 A1 Jul. 27, 2017

(30) Foreign Application Priority Data

Jan. 21, 2016 (GB) ..... 1601214.8

(51) Int. Cl.
*F04D 29/44* (2006.01)
*F04D 29/66* (2006.01)
*F04D 29/42* (2006.01)

(52) U.S. Cl.
CPC ..... *F04D 29/441* (2013.01); *F04D 29/4213* (2013.01); *F04D 29/66* (2013.01); *F04D 29/665* (2013.01)

(58) Field of Classification Search
CPC ..... F02B 37/14; F02B 37/04; F04D 29/441; F04D 29/4213; F04D 29/66;
(Continued)

(56) References Cited

U.S. PATENT DOCUMENTS 5,505,588 A * 4/1996 Bruhwiler ..... F01D 9/065 415/112
9,003,791 B2 4/2015 Ibaraki et al.
(Continued)

FOREIGN PATENT DOCUMENTS

CN 101251129 A 8/2008
CN 101663489 A 3/2010
(Continued)

OTHER PUBLICATIONS

Great Britain Patent Office, Great Britain Search Report for Great Britain Application No. 1601214.8, dated May 31, 2016.
(Continued)

*Primary Examiner* — Syed O Hasan
(74) *Attorney, Agent, or Firm* — Lorenz & Kopf LLP

(57) ABSTRACT

A compressor housing includes a compressor inlet duct and an inlet for a compressor wheel. The compressor inlet duct has a longitudinal axis and connects an air intake duct with the compressor wheel inlet. The compressor housing includes at least one appendix positioned between an upstream portion of the compressor inlet duct and the compressor wheel inlet. The appendix includes a pipe closed in a distal part thereof with respect to the longitudinal axis of the compressor inlet duct.

13 Claims, 4 Drawing Sheets

(58) Field of Classification Search
CPC ..... F04D 29/665; F04D 17/10; F04D 29/284; F04D 29/4206; F04D 27/009; F01M 2013/027
See application file for complete search history.

(56) References Cited

U.S. PATENT DOCUMENTS

| | | | | |
|---|---|---|---|---|
| 2010/0005799 | A1* | 1/2010 | Nikpour | F04D 27/0207 60/605.1 |
| 2010/0278635 | A1 | 11/2010 | Schoeman | |
| 2013/0343886 | A1* | 12/2013 | Karim | F04D 27/0246 415/208.1 |
| 2016/0069302 | A1 | 3/2016 | Tabata | |

FOREIGN PATENT DOCUMENTS

| | | | |
|---|---|---|---|
| CN | 103511337 | A | 1/2014 |
| DE | 102012200866 | A1 | 7/2013 |
| EP | 0651162 | A1 | 5/1995 |
| EP | 2063130 | A1 | 5/2009 |

OTHER PUBLICATIONS

State Intellectual Property Office of the People's Republic of China, Chinese Search Report for Chinese Application No. 201710053138.1, dated May 29, 2019.

* cited by examiner

COMPRESSOR HOUSING

CROSS-REFERENCE TO RELATED APPLICATION

This application claims priority to Great Britain Patent Application No. GB1601214.8, filed Jan. 21, 2016, which is incorporated herein by reference in its entirety.

TECHNICAL FIELD

The present disclosure generally pertains to turbomachinery and more particularly to a compressor housing configuration.

BACKGROUND

Compressors are used in wide variety of applications. For example, internal combustion engines may be provided with a forced air system such as a turbocharger to increase an engine efficiency and power by forcing extra air into the combustion chambers of the cylinders. The turbocharger includes a compressor rotationally coupled to a turbine.

Compressor operations at low mass flow rates are limited in pressure ratio by the surge limit, namely a threshold above which severe fluid dynamic instabilities may occur. Moreover, compressor operations close to surge may be associated with a noise which is known in the art as "whoosh" noise.

There is a need in art to enlarge the operative portion of the compressor map to achieve significant improvements on the compressor surge margin towards smaller flow rates. There is also a need in the art to reduce compressor noise, achieving significant dampening around a frequency range commonly used and improving customer satisfaction.

SUMMARY

An embodiment of the present disclosure provides a compressor housing including a compressor inlet duct and an inlet for a compressor wheel. The compressor inlet duct has a longitudinal axis and connects an air intake duct with the compressor wheel inlet. The compressor housing includes at least one appendix positioned between an upstream portion of the compressor inlet duct and the compressor wheel inlet. The appendix includes a pipe closed at a distal end thereof with respect to the longitudinal axis of the compressor inlet duct. An advantage of this embodiment is that the introduction of an appendix including a closed pipe and integrated into the compressor housing at its inlet has proven to be effective in enlarging the operative portion of the compressor map by shifting the surge limit towards smaller mass flow rates. The fluid dynamic phenomenon induced by the proximal end of the closed pipe allows the achievement of higher pressure ratios at small mass flow rates. In automotive and heavy duty engines, this improvement is directly translated into higher low-end torque with no compromises in peak power performance. A further advantage is the achievement of significant noise dampening at different mass flow rates, especially in the frequency range related to the "whoosh" noise phenomenon that is particularly severe in automotive applications and is hereby reduced.

In another embodiment, the at least one appendix protrudes externally with respect to an external surface of the compressor housing inlet. An advantage of this embodiment is its effectiveness at any angular position along the surface of the compressor inlet duct, allowing a significant flexibility in packaging constrained applications.

In another embodiment, the at least one appendix has an axis that is inclined with respect to the longitudinal axis of the compressor inlet duct by an angle of inclination included between 10° and 90°. An advantage of this embodiment is that it allows to optimize the appendix inclination with respect to the longitudinal axis of the compressor inlet duct having regard to space constraints and performance.

In still another embodiment, the at least one appendix is inclined with respect to the external surface of the compressor housing by an angle of inclination included between 10° and 170°. The angle of inclination being included is defined between a plane tangent to the external surface of the compressor housing and passing through an intersection point between the axis of the at least one appendix and the external surface of the compressor housing, and a plane including the longitudinal axis of the compressor inlet appendix and perpendicular to a transversal section of the compressor inlet duct. An advantage of this embodiment is that it allows to optimize the appendix inclination with respect to the compressor housing having regard to space constraints and performance.

According to a further embodiment, a proximal part of the at least one appendix with respect to the longitudinal axis of the compressor inlet duct intersects the compressor inlet duct defining an upstream connection lip and a downstream connection lip.

According to still another embodiment, the minimum distance between the downstream connection lip of an internal surface of the compressor inlet duct and the compressor wheel inlet is between zero and three times the diameter of the compressor wheel at the compressor wheel inlet. An advantage of this embodiment is that it allows an optimal positioning of the appendix.

According to still another embodiment, the minimum distance between the upstream connection lip of an internal surface of the compressor inlet duct and the bottom wall of the at least one appendix is at least half of the diameter of the compressor wheel at the compressor wheel inlet. An advantage of this embodiment is that an optimal length of the appendix can be identified.

The present disclosure further includes a compressor assembly including a compressor housing and a compressor equipped with a compressor wheel fitted in a compressor wheel seat. The present disclosure further includes an automotive system equipped with a compressor assembly.

BRIEF DESCRIPTION OF THE DRAWINGS

The present disclosure will hereinafter be described in conjunction with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any theory presented in the preceding background of the invention or the following detailed description.

The various embodiments of the present disclosure are applicable to compressors in general. Some embodiments of the present disclosure will be now described with reference to an automotive system 100, however other compressor applications may be equipped with the compressor assembly according to the various embodiments of the present disclosure.

Figure 1:
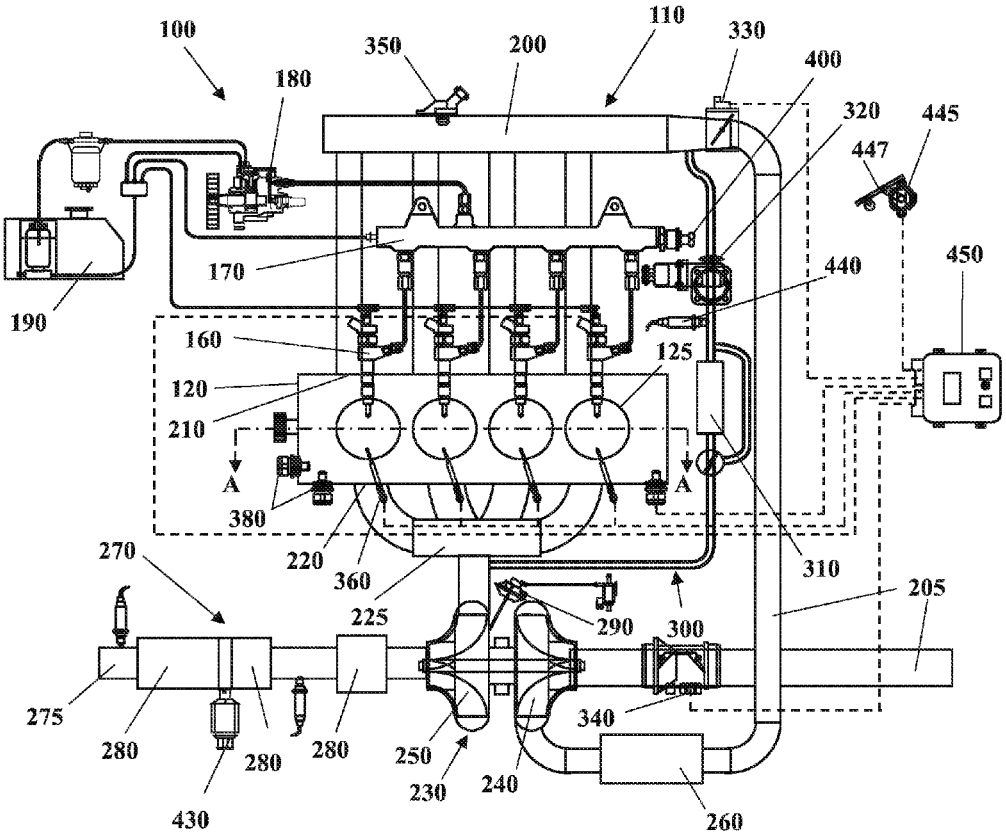
FIG. 1 shows an automotive system.
Figure 2:
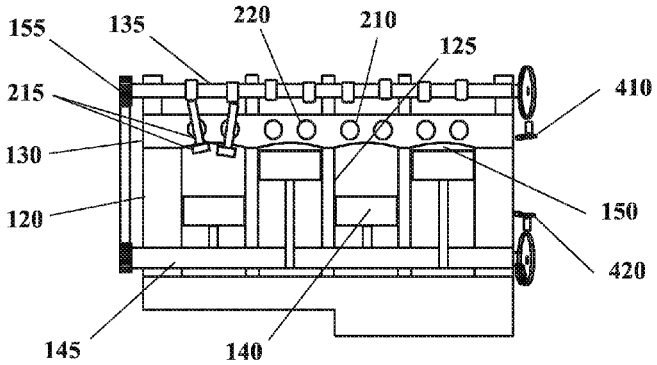
FIG. 2 is a cross-section of an internal combustion engine belonging to the automotive system of FIG. 1.

Some embodiments may include an automotive system 100, as shown in FIGS. 1 and 2, that includes an internal combustion engine (ICE) 110 having an engine block 120 defining at least one cylinder 125 having a piston 140 coupled to rotate a crankshaft 145. A cylinder head 130 cooperates with the piston 140 to define a combustion chamber 150.

A fuel and air mixture (not shown) is disposed in the combustion chamber 150 and ignited, resulting in hot expanding exhaust gasses causing reciprocal movement of the piston 140. The fuel is provided by at least one fuel injector 160 and the air through at least one intake port 210. The fuel is provided at high pressure to the fuel injector 160 from a fuel rail 170 in fluid communication with a high-pressure fuel pump 180 that increases the pressure of the fuel received from a fuel source 190. Each of the cylinders 125 has at least two valves 215, actuated by a camshaft 135 rotating in time with the crankshaft 145. The valves 215 selectively allow air into the combustion chamber 150 from the port 210 and alternately allow exhaust gases to exit through a port 220. In some examples, a cam phaser 155 may selectively vary the timing between the camshaft 135 and the crankshaft 145.

The air may be distributed to the air intake port(s) 210 through an intake manifold 200. An air intake duct 205 may provide air from the ambient environment to the intake manifold 200. In other embodiments, a throttle body 330 may be provided to regulate the flow of air into the manifold 200. In still other embodiments, a forced air system such as a turbocharger 230, having a compressor 240 rotationally coupled to a turbine 250, may be provided. Rotation of the compressor 240 increases the pressure and temperature of the air in the duct 205 and manifold 200. A charge air cooler 260 disposed in the duct 205 may reduce the temperature of the air. The turbine 250 rotates by receiving exhaust gases from an exhaust manifold 225 that directs exhaust gases from the exhaust ports 220 and through a series of vanes prior to expansion through the turbine 250. The exhaust gases exit the turbine 250 and are directed into an exhaust system 270. This example shows a variable geometry turbine (VGT) with a VGT actuator 290 arranged to move a rack of vanes 295 in different positions, namely from a fully closed position to a fully open position, to alter the flow of the exhaust gases through the turbine 250. In other embodiments, the turbocharger 230 may be fixed geometry and/or include a waste gate.

The exhaust gases of the engine are directed into an exhaust system 270. The exhaust system 270 may include an exhaust pipe 275 having one or more exhaust aftertreatment devices 280. The aftertreatment devices may be any device configured to change the composition of the exhaust gases. Some examples of aftertreatment devices 280 include, but are not limited to, catalytic converters (two and three way), oxidation catalysts, lean $NO_x$ traps, hydrocarbon adsorbers, selective catalytic reduction (SCR) systems, and particulate filters.

Other embodiments may include an exhaust gas recirculation (EGR) system 300 coupled between the exhaust manifold 225 and the intake manifold 200. The EGR system 300 may include an EGR cooler 310 to reduce the temperature of the exhaust gases in the EGR system 300. An EGR valve 320 regulates a flow of exhaust gases in the EGR system 300.

While the first EGR conduit defines a short route for the exhaust gas recirculation, in accordance with the present disclosure, a second EGR conduit 600 which fluidly connects the exhaust line downstream of the aftertreatment systems to the intake duct upstream the intake manifold and is connected therein by the interposition of a three-way valve 500, may be provided. The second EGR conduit 600 defines a long route which includes also a relevant portion of the exhaust line and a relevant portion of the intake duct.

The automotive system 100 may further include an electronic control unit (ECU) 450 in communication with one or more sensors and/or devices associated with the ICE 110 and with a memory system and an interface bus. The ECU 450 may receive input signals from various sensors configured to generate the signals in proportion to various physical parameters associated with the ICE 110. The sensors include, but are not limited to, a mass airflow and temperature sensor 340, a manifold pressure and temperature sensor 350, a combustion pressure sensor that may be integral within glow plugs 360, coolant and oil temperature and level sensors 380, a fuel rail pressure sensor 400, a cam position sensor 410, a crank position sensor 420, exhaust pressure and temperature sensors 430, an EGR temperature sensor 440, and an accelerator pedal 447 position sensor 445. Furthermore, the ECU 450 may generate output signals to various control devices that are arranged to control the operation of the ICE 110, including, but not limited to, the fuel injectors 160, the throttle body 330, the EGR Valve 320, a Variable Geometry Turbine (VGT) actuator 290, and the cam phaser 155. Note, dashed lines are used to indicate communication between the ECU 450 and the various sensors and devices, but some are omitted for clarity.

Figure 3:
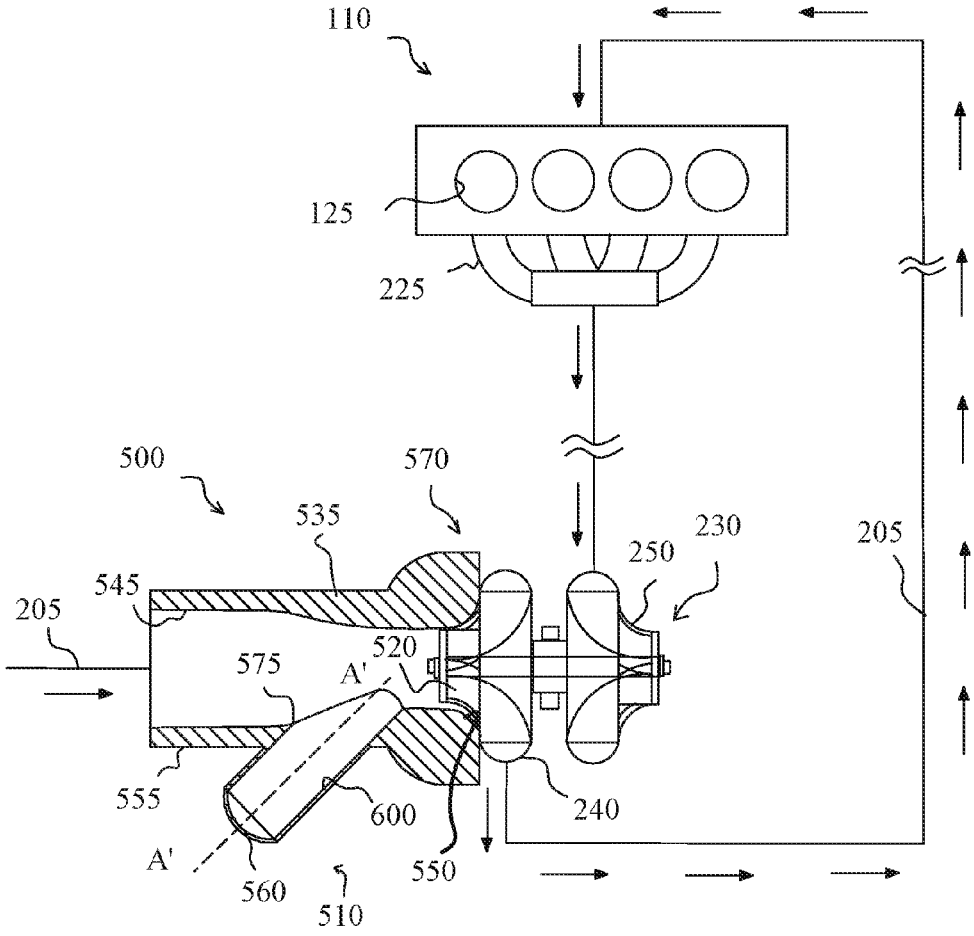
FIG. 3 shows a portion of the automotive system of FIG. 1 provided with a compressor assembly according to an embodiment of the present disclosure.

FIG. 3 shows a portion of the turbocharged automotive system of FIG. 1 provided with a compressor assembly 570 according to an embodiment of the present disclosure. The gas entering the compressor assembly 570 comes from an air intake duct 205.

Depending on the configuration of the automotive system 100, in the air intake duct 205 either fresh air or a gas mixture of fresh air and recirculated exhaust gas can be present. Rotation of the compressor 240 increases the pressure and temperature of the gas coming from the air intake duct 205. The gas exiting from the compressor assembly 570 is directed through the air intake duct 205 towards the engine block 120.

In the compressor assembly 570, the compressor 240 is connected to a compressor housing 500. The compressor housing 500 is provided with a compressor inlet duct 535 and an inlet 550 for a compressor wheel 520. The compressor inlet duct 535 has a longitudinal axis A-A (FIG. 4) and connects the air intake duct 205 with a compressor wheel inlet 550 of the compressor wheel 520 of the compressor 240. The compressor housing 500 includes an appendix 510, placed between an upstream portion 545 of the compressor inlet duct 535 and the compressor wheel inlet 550. Moreover, in the compressor assembly 570, the air intake duct 205 is connected to the compressor inlet duct 535 of the compressor housing 500 so that air or gas-air mixture coming from the air intake duct 205 enters the compressor inlet duct 535 before reaching the compressor 240.

Figure 4:
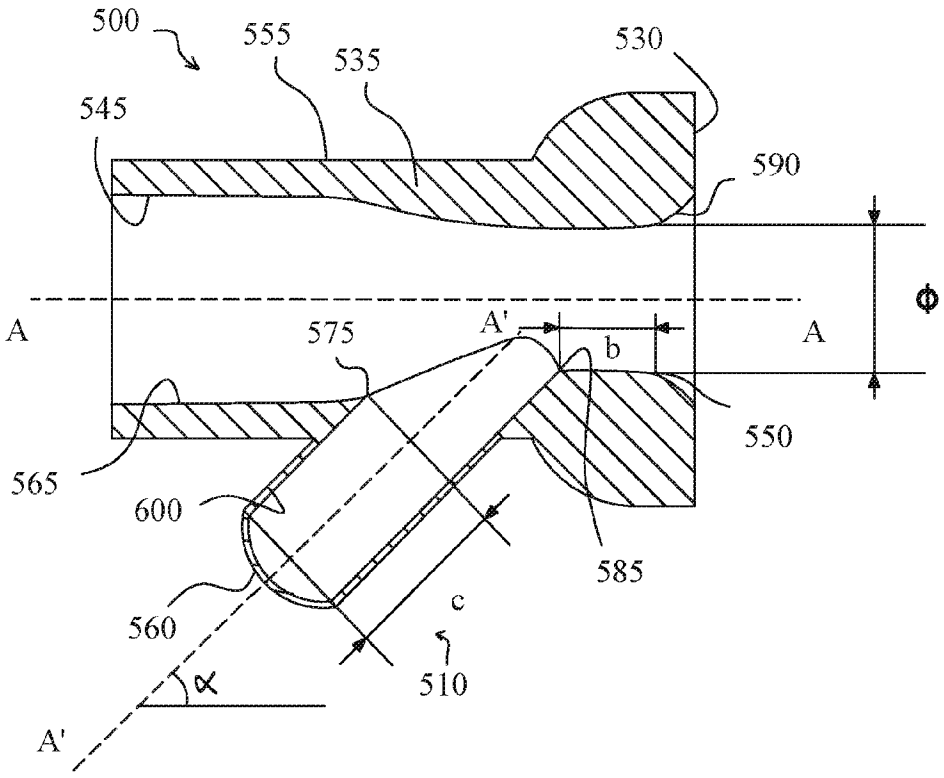
FIG. 4 shows a longitudinal section of a compressor housing according to an embodiment of the present disclosure.

FIG. 4 shows a longitudinal section of the compressor housing 500 according to an embodiment of the present disclosure. The appendix 510 protrudes externally with respect to an external surface 555 of the compressor housing 500. The appendix 510 includes a closed pipe 600. The pipe 600 is preferably closed by a bottom wall 560, in a distal part thereof with respect to a longitudinal axis A-A of the compressor inlet duct 535.

The appendix 510 has an axis A'-A' that is inclined with respect to the longitudinal axis A-A of the compressor inlet duct 535 by an angle of inclination $\alpha$ included between 10° and 90°. A preferred option for angle $\alpha$ is 45°.

The minimum distance b between a downstream connection lip 585 of an internal surface 565 of the compressor inlet duct 535 and the compressor wheel inlet 550 is included between 0 and three times the diameter $\Phi$ of the compressor wheel 520 at the compressor wheel inlet 550. A preferred option for the distance b is 0.5 $\Phi$.

The minimum distance c between an upstream connection lip 575 of an internal surface 565 of the compressor inlet duct 535 and the bottom wall 560 of the appendix 510 is at least half of the diameter $\Phi$ of the compressor wheel 520 at the compressor wheel inlet 550. A preferred option for the above detailed minimum distance c is from 1 $\Phi$ to 3 $\Phi$.

Figure 5:
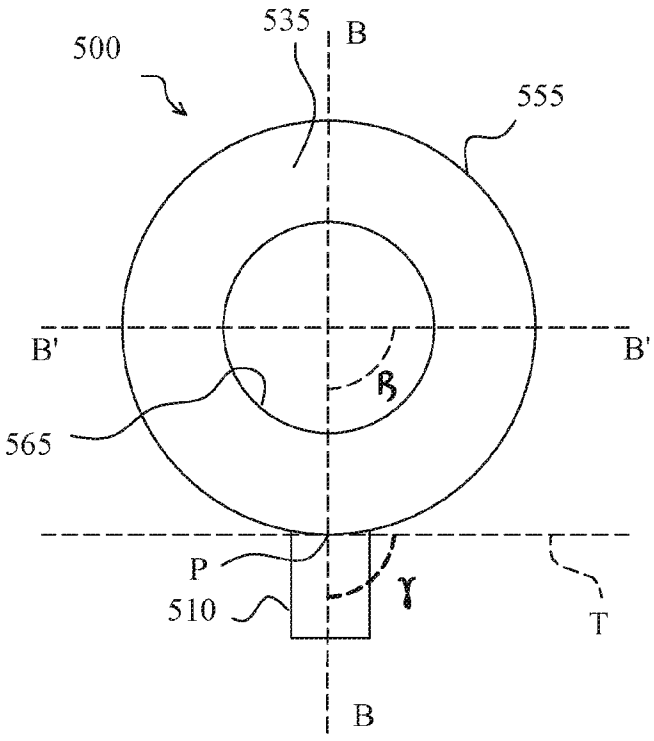
FIG. 5 shows a frontal view of the compressor housing assembly of FIG. 4.

FIG. 5 shows a frontal view of the compressor housing assembly of FIG. 4. A projection B-B of the axis A'-A' of the at least one appendix 510 onto a plane perpendicular to the longitudinal axis A-A of the compressor inlet duct 535 is inclined with respect to a tangent T to the external surface 555 of the compressor housing 500 by an angle of inclination $\gamma$ included between 10° and 170°.

In other words, the appendix 510 is inclined with respect to the external surface 555 of the compressor housing 535 by an angle of inclination $\gamma$ included between 10° and 170°, the angle of inclination $\gamma$ being included between a plane tangent to the external surface 555 of the compressor housing 535 and passing through an intersection point P between the axis A'-A' of the at least one appendix 510 and the external surface 555 of the compressor housing 535, and a plane perpendicular to a transversal section of the compressor inlet duct 535 including the axis A'-A' of the appendix 510.

The position of the appendix 510 with respect to the compressor inlet duct 535 can be further defined by the angle $\beta$ represented in FIG. 4. Angle $\beta$ can be defined as the angle included between the projection B-B of the axis A'-A' of the at least one appendix 510 onto a plane perpendicular to the longitudinal axis A-A of the compressor A'-A' and an axis B'-B' perpendicular to the axis A-A of the compressor housing duct 535 and substantially parallel to tangent T to the external surface 555 of the compressor housing 500. In other embodiments of the present disclosure, the appendix 510 may be placed in different positions defined by different $\beta$ angles.

The appendix 510 described above and represented in FIGS. 3-5 can assume any section shape, depending on design needs. In other embodiments of the present disclosure, the compressor housing 500 may be provided with more than one appendix. Furthermore, the bottom wall 560 of the closed pipe 600 of the appendix 510 is represented in FIGS. 3-5 as a semi-spherical end cup, but may be designed with other shapes. Finally, the appendix 510 may be designed as a single piece, wherein the pipe 600 is closed at a distal part with respect to the longitudinal axis A-A of the compressor inlet duct 535 and open at a proximal part with respect to the longitudinal axis A-A of the compressor inlet duct 535.

Figure 6:
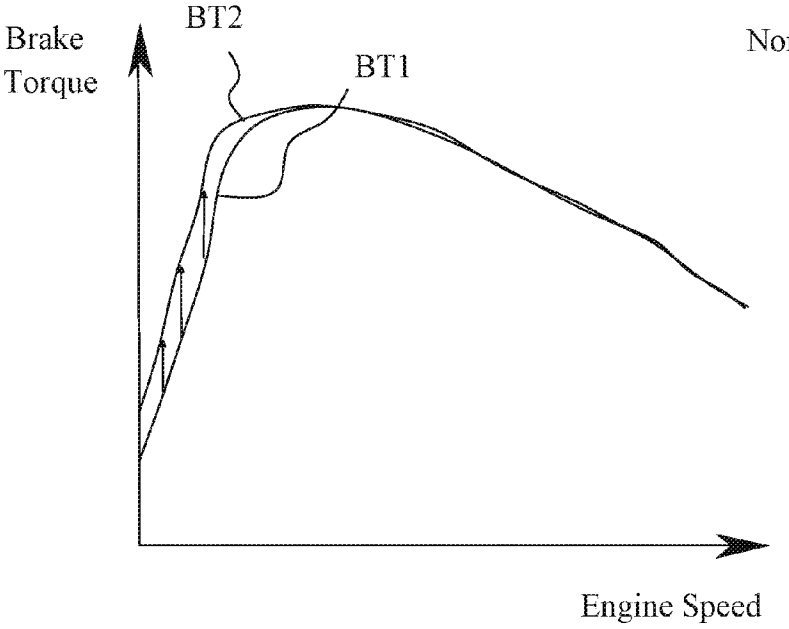
FIG. 6 shows a graph representing brake torque as a function of engine speed.

FIG. 6 shows a graph representing brake torque as a function of engine speed. In FIG. 6, BT1 represents a baseline Brake Torque line and BT2 a Brake Torque line due to the extra compressor surge obtained due to the configuration of the various embodiment of the present disclosure.

Figure 7:
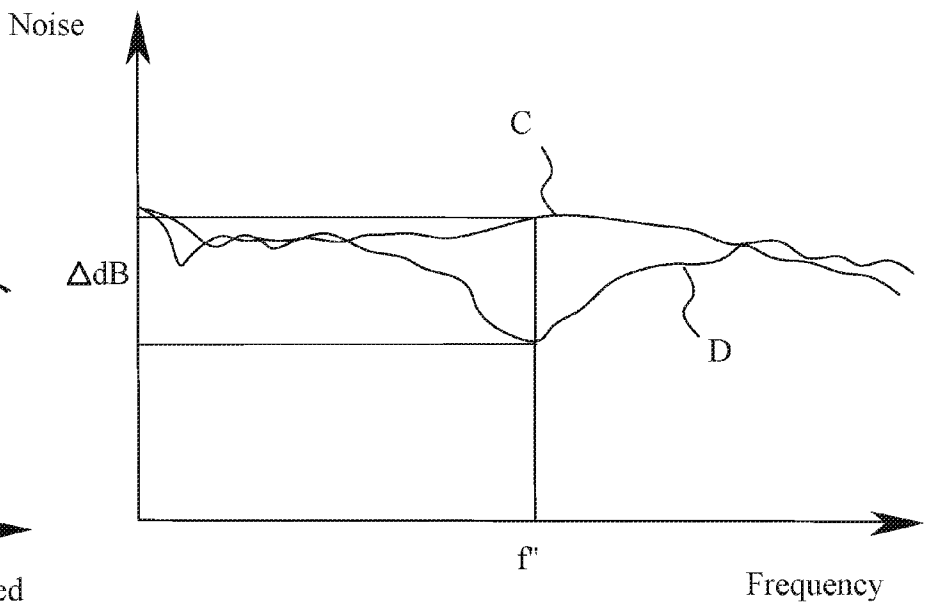
FIG. 7 shows a graph representing a comparison between the noise produced by a conventional compressor and the noise produced by a compressor assembly according to an embodiment of the present disclosure.

FIG. 7 shows a graph representing a comparison between the noise produced by a compressor according to the prior art (curve C) and the noise produced by a compressor assembly according to an embodiment of the present disclosure (Curve D). A significant noise reduction is induced by the presence of the appendix 510 in the frequency band around f', e.g. around 1750 Hz. The noise reduction at such frequency band can be around 10 dB.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment, it being understood that various changes may be made in the function and arrangement of elements described in an exemplary embodiment without departing from the scope of the invention as set forth in the appended claims and their legal equivalents.

What is claimed is:

1. A compressor housing comprising: a compressor wheel inlet; a compressor duct providing fluid communication from an air inlet to the compressor wheel inlet and defining a longitudinal axis; and an appendix having a pipe with an open proximal part that intersects the compressor duct at an intersection and a closed distal part including a curved end cap with respect to the longitudinal axis of the compressor duct, wherein the appendix is positioned between an upstream portion of the compressor duct and the compressor wheel inlet, the appendix protruding along a linear appendix axis from the intersection to the closed distal part, the appendix axis being inclined with respect to the longitudinal axis of the compressor duct by an included angle of inclination, wherein the included angle is between 10° and 90°.

2. The compressor housing according to claim 1, wherein the included angle is 45°.

3. The compressor housing according to claim 2, wherein the housing has an outer surface and the appendix is inclined with respect to the outer surface by an angle of inclination defined between a first plane tangent to the outer surface and passing through an intersection point P between the appendix axis and the outer surface and a second plane perpendicular to a transverse section of the compressor duct and including the appendix axis, wherein the angle of inclination is between 10° and 170°.

4. The compressor housing according to claim 1, wherein the proximal part of the appendix with respect to the longitudinal axis intersects the compressor duct forming an upstream connection lip and a downstream connection lip on an internal surface of the compressor duct.

5. The compressor housing according to claim 4, wherein the downstream connection lip is spaced apart from the compressor wheel inlet by a first distance, wherein the distance is between zero times and three times a diameter of the compressor wheel at the compressor wheel inlet.

6. The compressor housing according to claim 4, wherein the upstream connection lip is spaced apart from a bottom wall of the appendix by a second distance, wherein the second distance is at least one-half of a diameter of the compressor wheel at the compressor wheel inlet.

7. A compressor housing comprising:

a compressor wheel inlet;

a compressor duct providing fluid communication from an air inlet to the compressor wheel inlet and defining a longitudinal axis;

an appendix having a pipe closed in a distal part thereof with respect to the longitudinal axis of the compressor duct, the appendix protruding externally from an outer surface of the compressor housing, wherein the appendix is positioned between an upstream portion of the compressor duct and the compressor wheel inlet, the appendix having an appendix axis that is inclined with respect to the longitudinal axis of the compressor duct by an included angle of inclination, wherein the included angle is 45°;

the housing having an outer surface and the appendix inclined with respect to the outer surface by an angle of inclination defined between a first plane tangent to the outer surface and passing through an intersection point P between the appendix axis and the outer surface and a second plane perpendicular to a transverse section of the compressor duct and including the appendix axis, wherein the angle of inclination is between 10° and 170°; and the distal part including a bottom wall that defines a curved end.

8. The compressor housing according to claim 7, wherein a proximal part of the appendix with respect to the longitudinal axis intersects the compressor duct forming an upstream connection lip and a downstream connection lip on an internal surface of the compressor duct.

9. The compressor housing according to claim 8, wherein the downstream connection lip is spaced apart from the compressor wheel inlet by a first distance, wherein the distance is between zero times and three times a diameter of the compressor wheel at the compressor wheel inlet.

10. The compressor housing according to claim 8, wherein the upstream connection lip is spaced apart from a bottom wall of the appendix by a second distance, wherein the second distance is at least one-half of a diameter of the compressor wheel at the compressor wheel inlet.

11. A compressor housing comprising:

a compressor wheel inlet;

a compressor duct providing fluid communication from an air inlet to the compressor wheel inlet and defining a longitudinal axis;

an appendix having a pipe closed in a distal part thereof with respect to the longitudinal axis of the compressor duct, wherein the appendix is positioned between an upstream portion of the compressor duct and the compressor wheel inlet;

a proximal part of the appendix with respect to the longitudinal axis intersecting the compressor duct to form an upstream connection lip and a downstream connection lip on an internal surface of the compressor duct, the appendix extending along an appendix axis that is inclined at a 45° angle with respect to the longitudinal axis, and the bottom wall defining a curved end of the appendix;

the downstream connection lip being spaced apart from the compressor wheel inlet by a first distance, wherein the distance is between zero times and three times a diameter of the compressor wheel at the compressor wheel inlet; and the upstream connection lip being spaced apart from a bottom wall of the appendix by a second distance, wherein the second distance is at least one-half of a diameter of the compressor wheel at the compressor wheel inlet.

12. The compressor housing according to claim 11, wherein the appendix protrudes externally from an outer surface of the compressor housing.

13. The compressor housing according to claim 11, wherein the housing has an outer surface and the appendix is inclined with respect to the outer surface by an angle of inclination defined between a first plane tangent to the outer surface and passing through an intersection point P between the appendix axis and the outer surface and a second plane perpendicular to a transverse section of the compressor duct and including the appendix axis, wherein the angle of inclination is between 10° and 170°.

* * * * *